US005156233A

United States Patent [19]

Olsen et al.

[11] Patent Number: 5,156,233

[45] Date of Patent: Oct. 20, 1992

[54] SAFETY ANCHOR FOR USE WITH SLOTTED BEAMS

[75] Inventors: Gene E. Olsen; Marlin H. Camp; Gary L. Schwab, all of Cokato; Ivan L. Blood, Minnetonka, all of Minn.

[73] Assignee: Machining & Welding By Olsen, Inc.

[21] Appl. No.: 549,053

[22] Filed: Jul. 6, 1990

[51] Int. Cl.[5] ..... E04G 21/32; A62B 35/00

[52] U.S. Cl. ..... 182/3

[58] Field of Search ..... 182/3-8, 182/36, 82, 100

[56] References Cited

U.S. PATENT DOCUMENTS

| | | | |
|---|---|---|---|
| 2,685,331 | 8/1954 | Gauntlett | 182/4 |
| 3,200,904 | 8/1965 | Weeks | 182/3 |
| 3,860,089 | 1/1975 | Huggett | 182/4 |
| 4,295,543 | 10/1981 | Graham | 182/3 |
| 4,552,244 | 11/1985 | Maciejczak | 182/3 |
| 4,709,782 | 12/1987 | Lipinski | 182/3 |
| 4,767,091 | 8/1988 | Cuny | 182/36 |

*Primary Examiner*—Reinaldo P. Machado
*Attorney, Agent, or Firm*—Moore & Hansen

[57] ABSTRACT

A safety anchor including a pair of rectangular plates connected by a spring-loaded hinge assembly which normally biases the plates toward one another in a completely folded configuration. Each plate defines an aperture aligned with the opposing aperture when the plates are completely folded together. A double locking safety hook may be clipped through the apertures, and prevents the plates from being unfolded. Each plate includes a retention post fixedly attached thereto and extending outwardly beyond the rear edge of the associated plate. Each retention post has an enlarged head with two flat surfaces. The flat surfaces may be aligned with the slot in the beam and inserted therethrough into a recessed cavity when the plates are completely unfolded. When the plates are then folded together, the retention posts rotate relative to the slot and the enlarged heads become engagingly retained within the recessed cavity and behind the narrower slot. The spaced-apart retention posts prevent rotation or rocking of the safety anchor. During a fall, the plates of the safety anchor will cam against the face of the beam, and the hinge assembly will bear no load. Once the safety link is detached, the safety anchor may be removed and remounted on another beam using only one hand. The safety anchor is particularly suited for use with horizontal slotted beams and associated components utilized in erecting concrete pouring forms of the type referred to as "flying forms."

30 Claims, 5 Drawing Sheets

SAFETY ANCHOR FOR USE WITH SLOTTED BEAMS

BACKGROUND OF THE INVENTION

This invention relates generally to safety links or devices for preventing hazardous falls by construction workers, and particularly to a safety device which may be removably attached to a slotted metal beam in a concrete pouring form and used by the worker to anchor a safety line or harness.

The safety device of this invention is particularly suited for use with slotted beams of the type used for erecting concrete pouring forms as shown and described in U.S. Pat. Nos. 3,899,152; 4,144,690; and 4,156,999 to Avery, as well as U.S. Pat. No. 4,033,544 to Johnston. To the extent that those patents are instructive as to the manufacture and assembly of the various components of those concrete pouring forms, the content of those disclosures are incorporated herein by reference.

In erecting the concrete pouring forms or "flying forms" as described, workers will generally climb on the horizontal beams and trusses surrounding the wooden forms and thereby use the beams as scaffolding, or hang scaffolding from those beams, to build the concrete pouring form from the bottom up. When a section of the concrete structure has been poured and cured sufficiently, the process of erecting the form may continue upwardly, or the form may be transferred or "flown" to a new location by crane.

As workers climb up the horizontal beams, they must be assembling components of the form by nailing, screwing, or bolting sections together. It is necessary to use long shebolts to connect the vertical stiff-backs or strong-backs that produce tension to compress and hold the form in the desired position. These shebolts are heavily greased, and must be pushed through holes in the beams and forms by workers clinging to the beams. These activities often involve the workers applying pressure to the form which tends to push the worker outwardly away from the form, thereby risking serious injury or death due to falls from great heights.

Climbers have sometimes used safety lines and harnesses with snap links or spring-loaded carabiners for protection, either wrapping a section of the safety line around a structural member, or more frequently hooking the safety link over the edge or into the slot of a beam. However, the normal movement of climbing the beams or scaffolding and working on the forms will cause the safety links to "roll-out" without the worker being aware or in a position to reset the link, thereby rendering the safety line useless. Similarly, wrapping a section of the safety line around a structural member may not provide the necessary strength to catch the worker in a fall if the line is positioned improperly, and wrapping or unwrapping the line generally requires two hands which often places the worker in a precarious position.

Various camming, jumar, and friends-type devices are known in the art for mountaineering. However, these mountaineering devices are not particularly suited for use as anchors on slotted or conventional beams or the other components of a concrete pouring form, and are not constructed to withstand the rigors and abuses associated with use in a heavy construction environment. Some of the devices particularly suited for window washers and painters are heavy-duty adaptations of mountaineering equipment, but generally relate to ascenders or jumars that may be attached to a tensioned vertical safety line and connected to a harness.

U.S. Pat. Nos. 3,348,632 to Swager and 4,767,091 to Cuny each disclose devices that slide along and clamp the flat face of a conventional I-beam or ride on and grip the edge surfaces of the flanges, the Cuny '091 patent disclosing pivoting side portions which permit attachment of the device to the beam. However, the device disclosed in Cuny '091 requires that a ring hold the two pivoting side portions together, and any slack or play in that ring can allow the sides to disengage from the beam. This is particularly true if an eccentric ring is used. The safety devices of Swager '632 and Cuny '091 are not designed for rapid or one-handed attachment or removal from the beams, and are oriented to clamp and cam against a vertical rather than a horizontal beam. Moreover, while the safety device of Cuny '091 is designed to wedge against the beam in case of a fall, the force of any fall is transferred directly to the pivot pin connecting the pivoting side portions, thereby weakening the device considerably.

U.S. Pat. No. 3,933,220 to Swager discloses a clamping device which is received through a slot in a vertical rail and which wedges or clamps against the interior of that rail under the weight of a fall, but which is not designed to be readily removed or disengaged from the rail.

BRIEF SUMMARY OF THE INVENTION

It is therefore one object of this invention to design a safety anchor for use particularly with slotted beams of the type used in constructing concrete pouring forms, and particularly to design that safety anchor so that it may be readily attached to and detached from the slotted beam by a worker using only one hand.

It is another object of this invention to design the above safety anchor such that it produces a camming effect against the beam face to reduce the sheer forces on those components engaged in the slotted beam, and to convert those forces to linear forces on the critical structural components.

It is a related object of this invention to design the above safety anchor such that it will not rotate, pivot, or rock within the slotted beam, thereby resisting torsional forces during a fall, and will further isolate hinge or pivot points from bearing the load during a fall.

It is a distinct object of this invention to design the above safety anchor such that it may be routinely used in horizontal slotted beams.

It is an additional object of this invention to design the above safety anchor such that it cannot be accidentally or unintentionally removed from the slotted beam while the attention of the worker is occupied, and cannot be improperly mounted on the slotted beam in a position other than to provide maximum protection.

Briefly described, the safety anchor of this invention includes a pair of rectangular plates connected by a spring-loaded hinge assembly which normally biases the plates toward one another in a completely folded configuration. Each plate defines an aperture aligned with the opposing aperture when the plates are completely folded together. A safety link may be clipped through the apertures, and prevents the plates from being unfolded. Each plate includes a retention post fixedly attached thereto and extending outwardly beyond the rear edge of the associated plate. Each retention post has an enlarged head with two flat surfaces. The flat surfaces may be aligned with the slot in the beam and inserted therethrough into a recessed cavity when the plates are completely unfolded. When the plates are then folded together, the retention posts rotate relative to the slot and the enlarged heads become engagingly retained within the recessed cavity and behind the narrower slot. The spaced-apart retention posts prevent rotation or rocking of the safety anchor. During a fall, the plates of the safety anchor will cam against the face of the beam, and the hinge assembly will bear no load. Once the safety link is detached, the safety anchor may be removed and remounted on another beam using only one hand. The safety anchor is particularly suited for use with horizontal slotted beams and associated components utilized in erecting concrete pouring forms of the type referred to as "flying forms."

DESCRIPTION OF THE PREFERRED EMBODIMENT

The safety anchor of this invention is shown in FIGS. 1–14 and referenced generally therein by the numeral 10.

Figure 1:
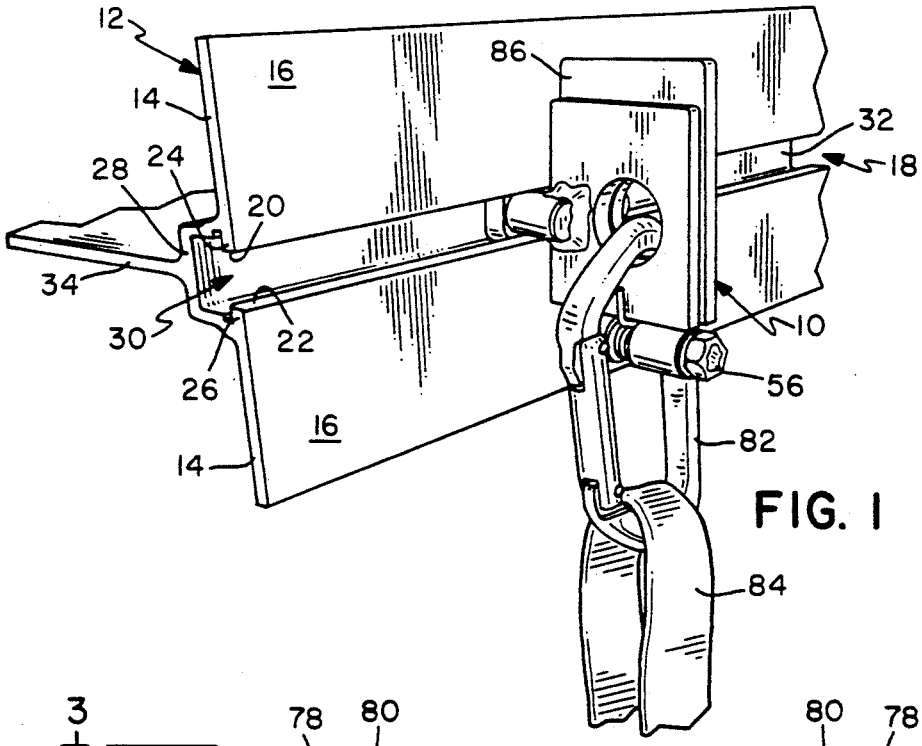
FIG. 1 is a front perspective view of the safety anchor of this invention mounted on a slotted beam with a carabiner and sling attached.

Referring to FIG. 1, it may be seen that the safety anchor 10 of this invention is particularly suited for use with an extruded aluminum metal beam 12 when that beam 12 is disposed in a generally horizontal orientation as shown in FIG. 1.

Figure 13:
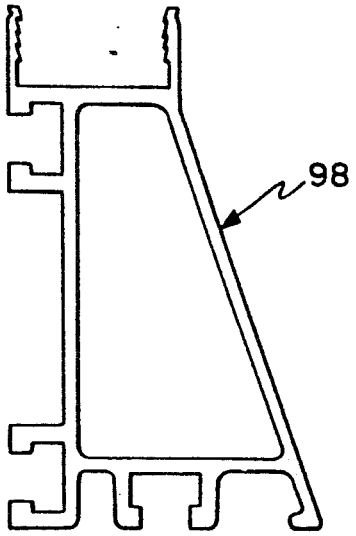
FIG. 13 is an end elevation view of the alternate type end beam of FIG. 11.

The beam 12, shown particularly in FIGS. 1 and 13, includes a pair of generally parallel face plates 14 together defining a generally planar facial surface 16 and a longitudinal slot 18 extending the length of the beam 12. The height or opening distance of the slot 18 adjacent the facial surface 16 is measured between the opposing surfaces 20, 22 of an upper lip 24 and closely confronting lower lip 26 which project downwardly and upwardly, respectively, and are displaced from one another by the height of the slot 18. The height of the slot 18 measured between the upper and lower lips 24, 26 is approximately .56 inches.

Extending rearwardly from and connecting each of the face plates 14 is a C-shaped base member 28, the base member 28 defining a recessed cavity 30 which communicates with and is a continuation of the slot 18. The recessed cavity 30 is disposed behind the upper and lower lips 24, 26 and has a transverse cross-section approximately equal in shape to that of a bolt head and washer assembly. The recessed cavity 30 preferably has an interior height greater than that of the slot 18, and is offset behind both the upper and lower lips 24, 26 so that the recessed cavity 30 is generally centered with the slot 18 along a line normal to the plane of the facial surfaces 16. The interior height of the recessed cavity 30 is approximately 0.7#7 inches with a width measured between the rear wall 32 of the recessed cavity 30 and the upper and lower lips 24, 26 of approximately 0.473 inches. The metal thickness of the base member 28 surrounding the recessed cavity 30 is approximately 0.236 inches, while the upper and lower lips 24, 26 each have a thickness of approximately 0.236 inches.

Figure 5:
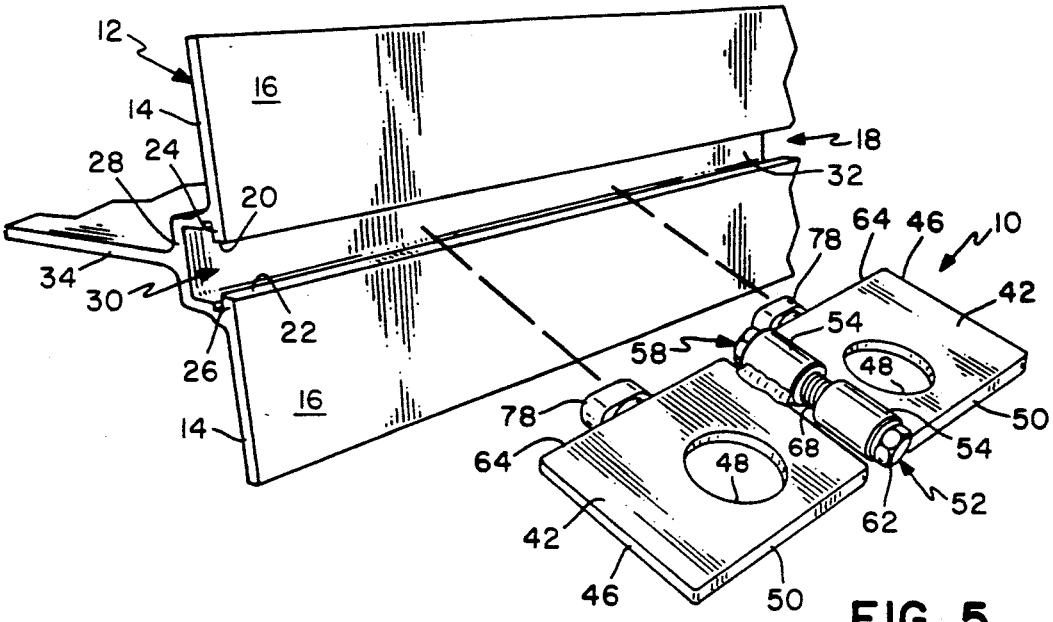
FIG. 5 is a front perspective view of the safety anchor of FIG. 1 completely unfolded and confronting but displaced from the face of a slotted beam.
Figure 12:
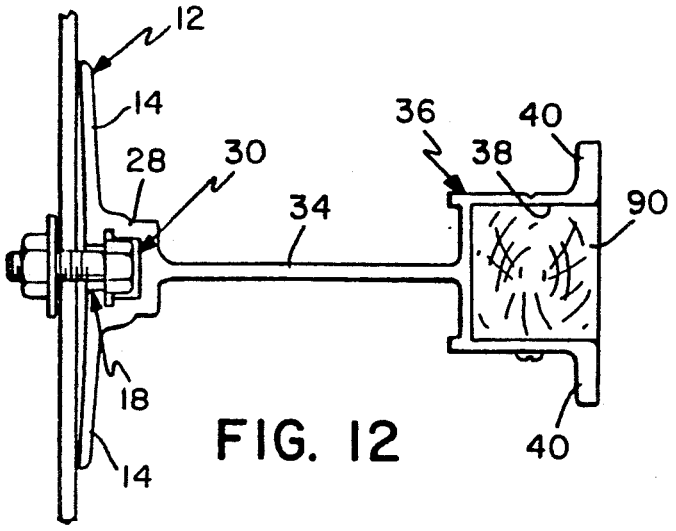
FIG. 12 is a end elevation view of the horizontal slotted beam of FIG. 10.

As may be seen in FIGS. 5 and 12, the beam 12 further includes a web segment 34 extending rearwardly from the base member 28, and an "top-hat" section 36 extending from and connected to the opposing end of the web segment 34 and defining a generally square C-shaped channel 38 and outwardly projecting opposing flanges 40 extending the length thereof. It should be noted that the portion of the beam 12 extending from the web segment 34 to the facial surface 16 is essentially a modified I-beam structure, while the "top-hat" section 36 is particularly adapted for use in constructing concrete forms as described in U.S. Pat. Nos. 3,899,152; 4,144,690; and 4,156,999 to Avery, as well as U.S. Pat. No. 4,033,544 to Johnston. Reference to those patents may be made concerning further details regarding the design or construction of the beams 12 with which the safety anchor 10 is used.

Figure 2:
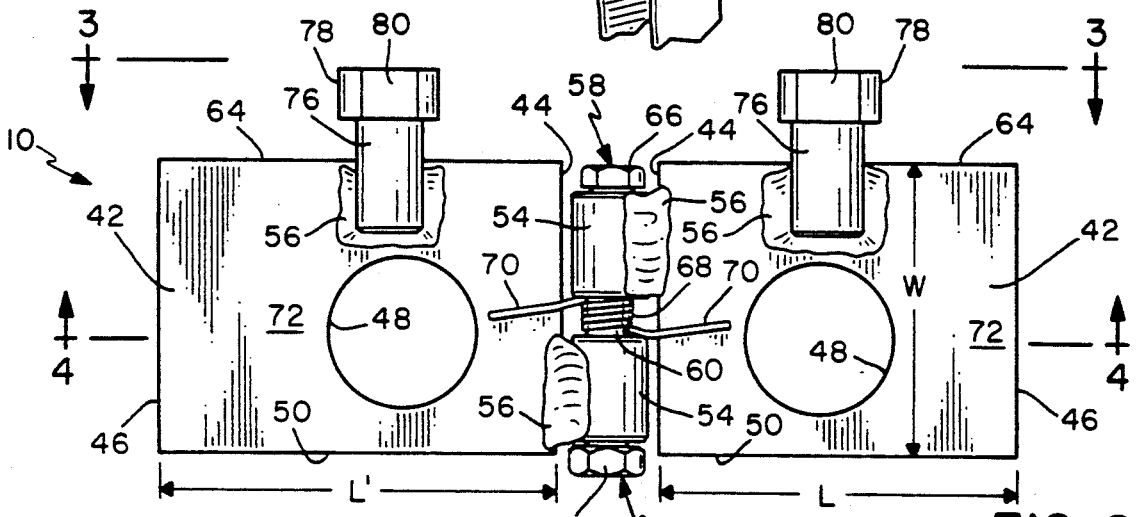
FIG. 2 is a top view of the safety anchor of FIG. 1 in the fully open position.
Figure 3:
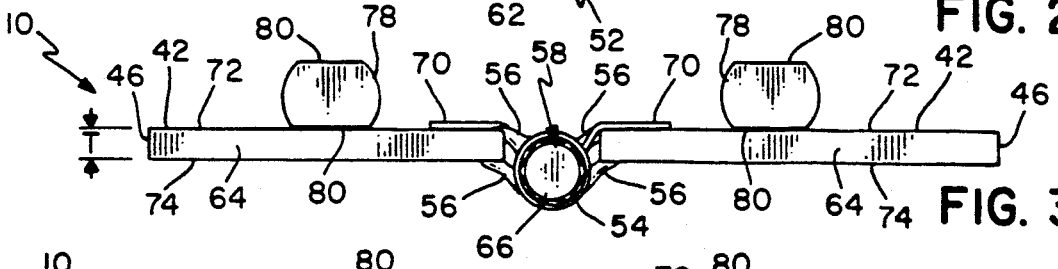
FIG. 3 is a rear elevation view of the safety anchor of FIG. 1.
Figure 4:
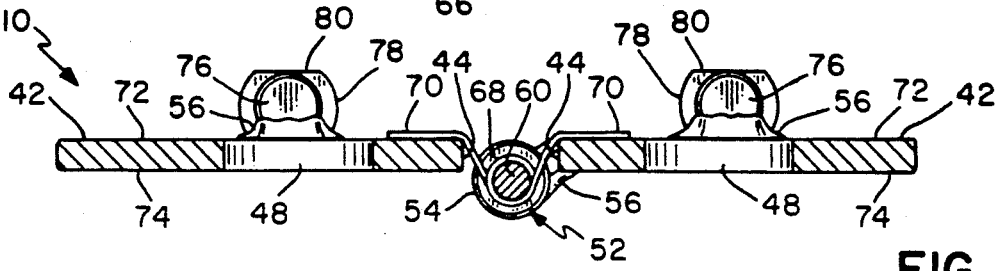
FIG. 4 is a cross section view of the safety anchor of FIG. 1 taken through line 4—4 of FIG. 2.

Referring to FIGS. 2–4, it may be seen that the safety anchor 10 has a pair of generally rectangular leaf members or plates 42, each plate 42 having a thickness T of approximately 0.25 inches, and a width W of 2.25 inches. The plates 42 each have a length L, L' measured between the inner edges 44 and outer edges 46 thereof, a first one of the plates 42 having a length L' greater than the second one of the plates 42. The longer plate 42 has a length L' of approximately 3.25 inches, while the shorter plate 42 has a length L of approximately 2.75 inches.

Each plate 42 defines generally circular aperture 48 extending entirely therethrough, each aperture 48 having a diameter of approximately 1.125 inches and a radius measured from a center point therein of approximately 0.5625 inches. The center point of each aperture 48 is spaced approximately 1.25 inches inwardly from the inner edge 44 of the respective plate 42, spacing the innermost point on the edge of each of the apertures 48 approximately, 0.6875 inches from the inner edge 44 of the respective plate 42. The center point of each aperture 48 is also spaced approximately 0.9375 inches from the front edge 50 of each plate 42, thereby spacing the frontmost point on the edge of each of the apertures 48 approximately 0.375 inches from the front edge 50 of the respective plate 42. While these dimensions have proven suitable for most applications, it is understood that other dimensions and tolerances for the safety anchor 10 may be preferable in different applications.

Each of the plates 42 are operatively connected together for pivotal movement by a hinge assembly 52. The hinge assembly 52 consists of a pair of cylindrical collars 54 each fixedly attached to the inner edge 44 of one of the plates 42 by welding 56, and a hinge pin 58 or hex-head bolt 58 having a threaded shaft 60 which extends through the aligned cylindrical bores of each of the collars 54. The hinge pin 58 forms a common axis for the collars 54, with the hinge pin 58 being received within at least a portion of each of the cylindrical bores such that the plates 42 may pivot freely relative to one another with the hinge pin 58 forming a pivotal axis therebetween. A nut 62 is threaded onto the end of the threaded shaft 60 of the hinge pin 58 opposing the hex-head thereof, and the nut 62 is fixedly attached to the threaded shaft 60 by welding or brazing. One of the collars 54 is disposed more closely adjacent to the front edge 50 of one plate 42, while the remaining collar is disposed more closely adjacent to the rear edge 64 of the opposing plate 42.

Each collar 54 has a diameter of approximately 625 inches and a length of approximately 0.8125 inches, each of the collars being spaced apart a distance of approximately 0.3125 inches. The top planar surface 66 of the hex-head of the hinge pin 58 is generally parallel with the rear edges 64 of the plates 42, or may be recessed from flush with the rear edges 64 of the plates 42 by approximately 0.0625 inches.

A coiled torsional spring 68 is carried on the hinge pin 58, the torsional spring 68 being disposed between and separating the collars 54 and wrapped surrounding the threaded shaft 60 of the hinge pin 58. Each of the ends 70 of the torsional spring 68 extend above and are in parallel abutting contact with the top planar surface 72 of one of the opposing plates 42, the torsional spring 68 thereby urging the plates 42 to pivot or rotate about an axis or rotation defined by the center of the threaded shaft 60 of the hinge pin 58, the torsional spring 68 providing sufficient pressure to normally urge or bias the bottom planar surfaces 74 of each of the plates 42 into contact with one another.

Fixedly attached to the top surface 72 of each of the plates 42 is a generally cylindrical retention post 76, each retention post 76 having an enlarged head 78 integrally formed at the rearmost end thereof. The cylindrical portion of each retention post 76 has a diameter of approximately 0.535 inches, and a length of approximately 0.8125 inches. Each retention post 76 is generally flush with and contacting the top surface 72 of the plate 42 to which it is fixedly attached by welding 56, the cylindrical portion of each retention post 76 extending inwardly onto the top surface 72 of the plate 42 from the rear edge 72 thereof by a distance of approximately 0.46875 inches. The remaining portion of each retention post 76 measured between the enlarged head 78 and the rear edge 72 of the plate is thereby greater than the thickness of the lips 24, 26 of the beam 12 by slightly less than 0.1 inches.

The longitudinal axis of the cylindrical portion of each retention post 76 is oriented generally normal to the rear edge 70 of the corresponding plate 42, so that the longitudinal axis intersects at least a portion of the aperture 48 and preferably is generally aligned with the center point of the aperture 48 defined by the corresponding plate 42. The longitudinal axis of the cylindrical portion of each retention post 76 is thereby spaced approximately 1.25 inches from the inner edge 44 of the corresponding plate 42.

Each of the enlarged heads 78 of the retention posts 76 has a rounded body shape with a diameter of approximately 0.75 inches and a length of approximately 0.375 inches, the enlarged head 78 being centered along the longitudinal axis of the respective retention posts 76. Each enlarged head 78 has a pair of opposing flattened sides or planar surfaces 80, each planar surface 80 being generally parallel with one another and flush with each opposing side of the cylindrical portion of the retention post 76. One planar surface 80 is disposed parallel and flush with the top surface 72 of the plate 42 to which the corresponding retention post 76 is attached. The displacement between the planar surfaces 80 of the enlarged head 78 is thus approximately 0.53125 inches, or less than the height of the slot 18 in the beam 12 by a distance of slightly less than 0.02 inches. The enlarged heads 78 of the retention posts 76 may thereby be received through the slot 18 of the beam 12 only when the planar surfaces 80 are oriented in general alignment with the surfaces 20, 22 of the upper and lower lips 24, 26 defining the slot 18, but permitting the enlarged head 78 to be received within the recessed cavity 30 when the planar surfaces 80 of the enlarged heads 78 are oriented in any direction.

Figure 6:
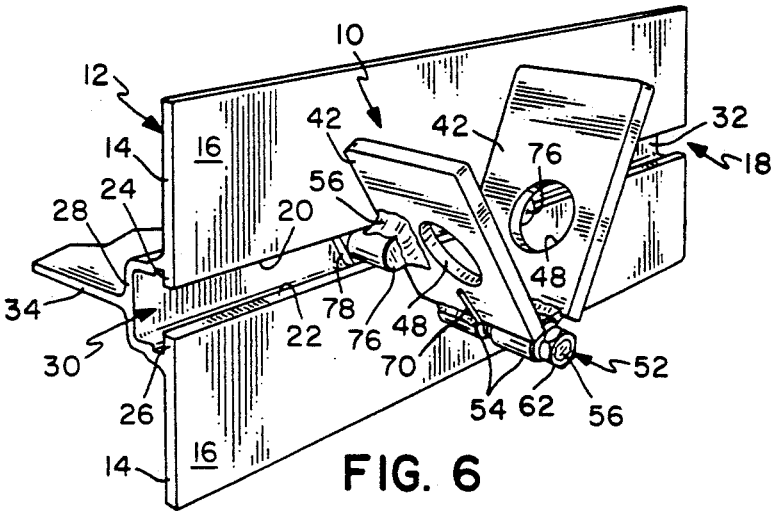
FIG. 6 is a front perspective view of the safety anchor of FIG. 5 partially folded and mounted on the slotted beam in partial engagement therewith.
Figure 7:
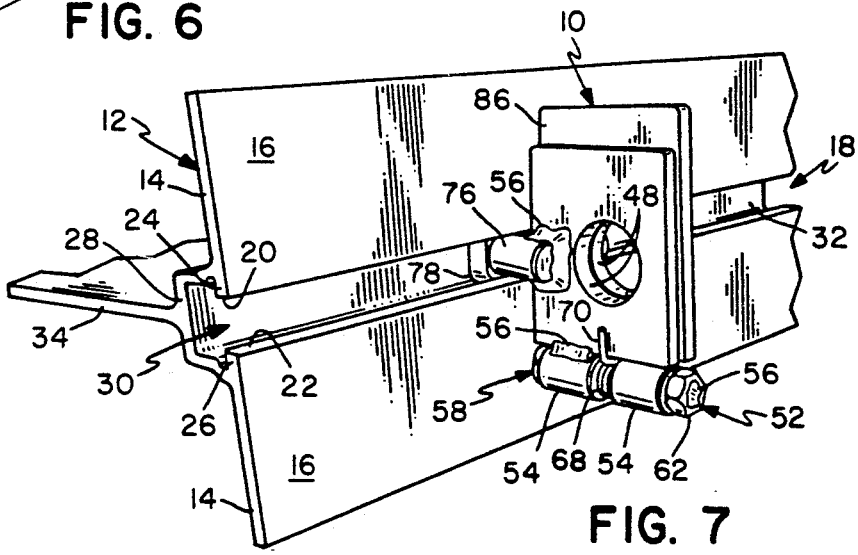
FIG. 7 is a front perspective view of the safety anchor of FIG. 5 completely folded and mounted on the slotted beam in full engagement therewith.

The enlarged heads 78 of the retention posts 76 may therefore be inserted into the recessed cavity 30 through the slot 18 when the plates 42 are in generally parallel alignment with one another in the completely unfolded configuration as shown in FIG. 5, but may not be withdrawn from the recessed cavity 30 through the slot 18 when the plates 42 are in a completely folded configuration as shown in FIG. 7, nor in the partially folded or partially unfolded configuration as shown in FIG. 6.

Figure 9:
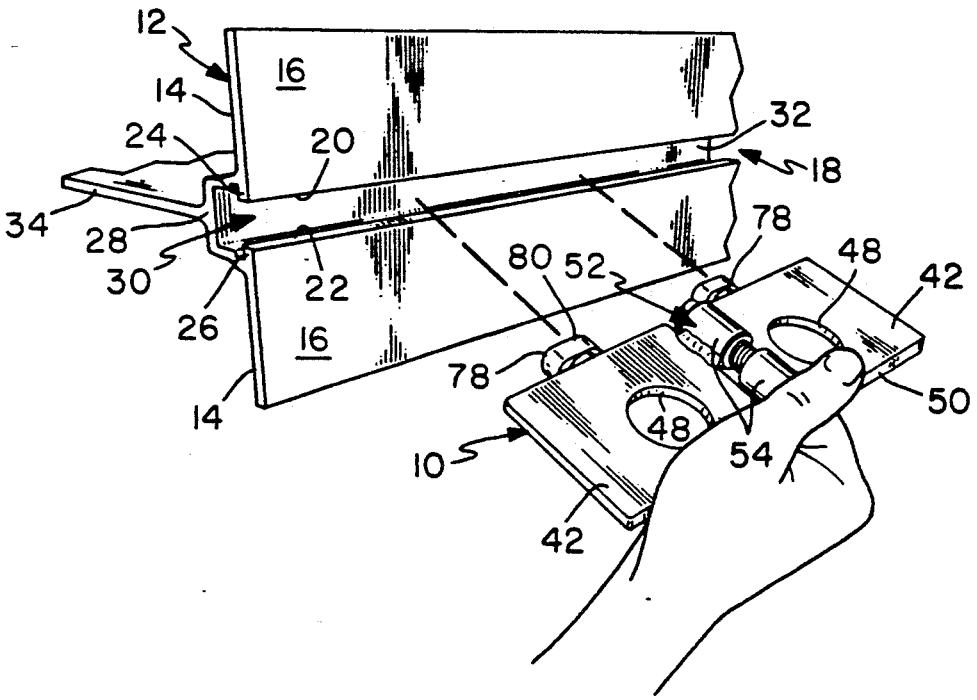
FIG. 9 is a front perspective view of the safety anchor of FIG. 1 completely unfolded and displaced from the face of a slotted beam, the safety anchor being gripped by the right hand of a user.

In operation, a worker or user may grip the safety anchor as shown in FIG. 9, with the fingers of the right hand resting under the safety anchor 10 and contacting both of the plates 42 to support the safety anchor 10 and press upwardly against the hinge assembly 52, with the distal end of the thumb pressing downwardly on the longer plate 42 and the heel or proximal end of the thumb pressing downwardly on the shorter plate 42. In this completely unfolded position or configuration, the planar surfaces 80 of the enlarged heads 78 of the retention posts 76 may be aligned with the slot 18 in the planar facial surface 16 of the beam 12. The safety anchor 10 may then be inserted through the slot 18 with the enlarged heads 78 being completely received in the recessed cavity 30, and the user's grip on the safety anchor 10 be relaxed completely released. Once the user's grip is relaxed or completely released, the force exerted on the plates 42 by the torsional spring 68 will cause the safety anchor 10 to fold upwardly to the partially folded position as shown in FIG. 6, and continue to fold upwardly and inwardly to the completely folded position as shown in FIG. 7 with the apertures 48 aligned.

Figure 8:
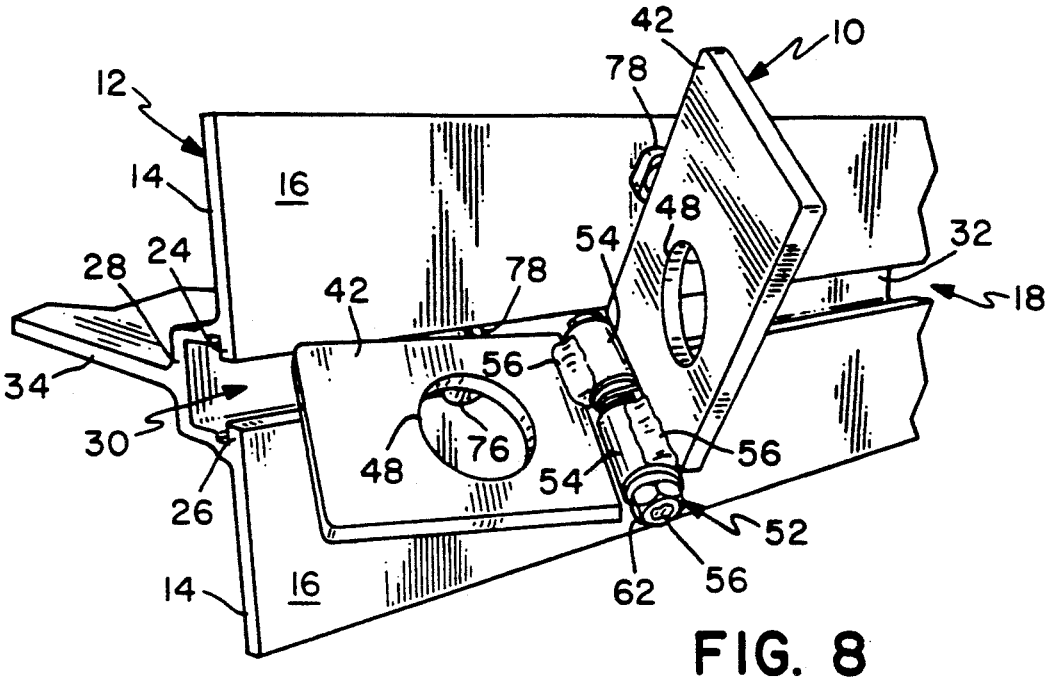
FIG. 8 is a front perspective view of the safety anchor of FIG. 5 partially folded and in misaligned contact with the slotted beam.

It should be noted that in the preferred embodiment, the dimensions of the safety anchor 10 and beam 12 are such that if the safety anchor 10 is misaligned or not completely received within the slot 18 with both enlarged heads 78 engagingly received within the recessed cavity 30, the safety anchor 10 will not completely fold. Because the radius from the hinge assembly 52 to the center of the retention post 76 is less than the height of the top face plate 14 measured above the slot 18, the retention post 76 on the single upwardly folded plate 42 will not extend above the top edge of the top face plate 14, and that retention post 76 will contact the planar facial surface 16 of the top face plate 14 to misalign the safety anchor 10 as shown in FIG. 8 so that neither of the enlarged heads 78 will engage within the slot 18. Since the safety anchor 10 will not completely fold in this instance, the worker cannot attach a carabiner 82 through both of the apertures 48, and the worker must necessarily re-engage the safety anchor 10. This helps to prevent workers from attempting to use the safety anchor 10 by relying on it only being partially engaged in the slot 18.

Once the safety anchor 10 is properly and engagingly mounted on the beam 12, as shown in FIG. 1, the user may then insert the carabiner 82 or similar safety link through both of the apertures 48, and allow the carabiner 82 and any safety line 84 to hang straight downwardly from the safety anchor 10.

A simple carabiner 82 of the type shown in U.S. Pat. No. 4,333,212 to Bibollet has been shown safety links are shown in U.S. Pat. Nos. 4,528,728 and 4,528,729 to Schmidt. It is anticipated that the safety anchor 10 may be dimensioned so as to accommodate any variety of safety links having large or small diameter hook mouths, and usable with double locking safety links having spring latches and trigger releases.

Similarly, the safety anchor 10 has been shown in FIG. 1 to be used with a one inch tubular webbing material as the safety line 84, while it may be preferred and recommended that a one to one and a half foot chain or cable be used in a construction environment to connect the safety anchor 10 so the harness (not shown) of the worker. With this particular combination, the safety anchor has proven capable of safely and reliably preventing the fall of a 280 lbs. worker.

When the safety anchor 10 is engagingly mounted on the beam 12 as shown in FIGS. 1 and 7, the inner edges 64 of the plates 42 will rest against or closely confronting the planar facial surface 16 of the lower face plate 14. The force of any fall will be converted substantially to downward tension on the safety anchor 10. The initial impact of a fall may exert upward and downward sheer forces on the retention posts 76 due to their contact with the lower lip 26 of the beam 12, those sheer forces being generally perpendicular or normal to the linear axis of the retention posts 76. However, any continuing downward tension on the safety line 84 or carabiner 82 from a dangling worker will cause the plates 42 to cam into the planar facial surface 16, and will exert a generally linear pulling force on the retention posts 76 and enlarged heads 78 against the rear sides of the upper and lower lips 24, 26 of the beam.

With the safety anchor 10 in the completely folded and engaging mounted position as shown in FIGS. 1 and 7, the spacing of the retention posts 76 prevents the safety anchor 10 from pivoting, rotating, or rolling to either side even if upward or sideways tension in placed on the safety line 84 or carabiner 82, and the plates 42 confronting the planar facial surface 16 prevent the safety anchor 10 from becoming dislodged due to rocking forward or backward normal to the beam 12. At most, the safety anchor may slide within the slot 18 if sideways tension is placed on the safety line 84 or carabiner 82. Consequently, both retention posts 76 are constantly maintained in the proper orientation and position so that they will bear any load during a fall generally equally, or the load will quickly balance between the two retention posts 76.

To remove the safety anchor 10 from the beam 12, the worker must first unclip the carabiner 82 from the apertures 48. The worker may then insert his thumb between the plates 42 by placing the distal end of the thumb on the top or outer edge 46 of the shorter plate 42, and rocking that thumb upwardly against the exposed portion 86 of the longer plate 42 extending above the outer edge 46 of the shorter plate 42, thereby causing the plates 42 to pivot apart a sufficient distance that the thumb may be inserted between the plates 42. The plates 42 of the safety anchor 10 may then be unfolded to the partially unfolded position as in FIG. 6, and the anchor 10 removed.

The worker may then pivot the plates 42 outwardly and downwardly to the completely unfolded position using one hand, as shown in FIGS. 5 and 9. The retention posts 76 and enlarged heads 78 may then be slidably removed from the slot 18, and the safety anchor completely disengaged from the beam 12.

It is anticipated that in some applications it may be desirable to rotate the planar surfaces 80 of the enlarged heads 78 of the retention posts 76 in opposing directions but through equal angles relative to the top planar surfaces 72 of the corresponding plates 42, such that the plates 42 and hinge assembly 52 must be pivoted greater or less than 180° relative to one another in order to align and insert the enlarged heads 78 through the slot 18 in the beam 12. One such angle which has proven suitable is 190°, thereby requiring the plates 42 to be pivoted or flexed slightly past parallel with one another for insertion mounting.

Referring to FIGS. 10–14, the safety anchor 10 of this invention is shown in operation with several types of conventional beams 12 used in the construction of concrete pouring forms.

Figure 10:
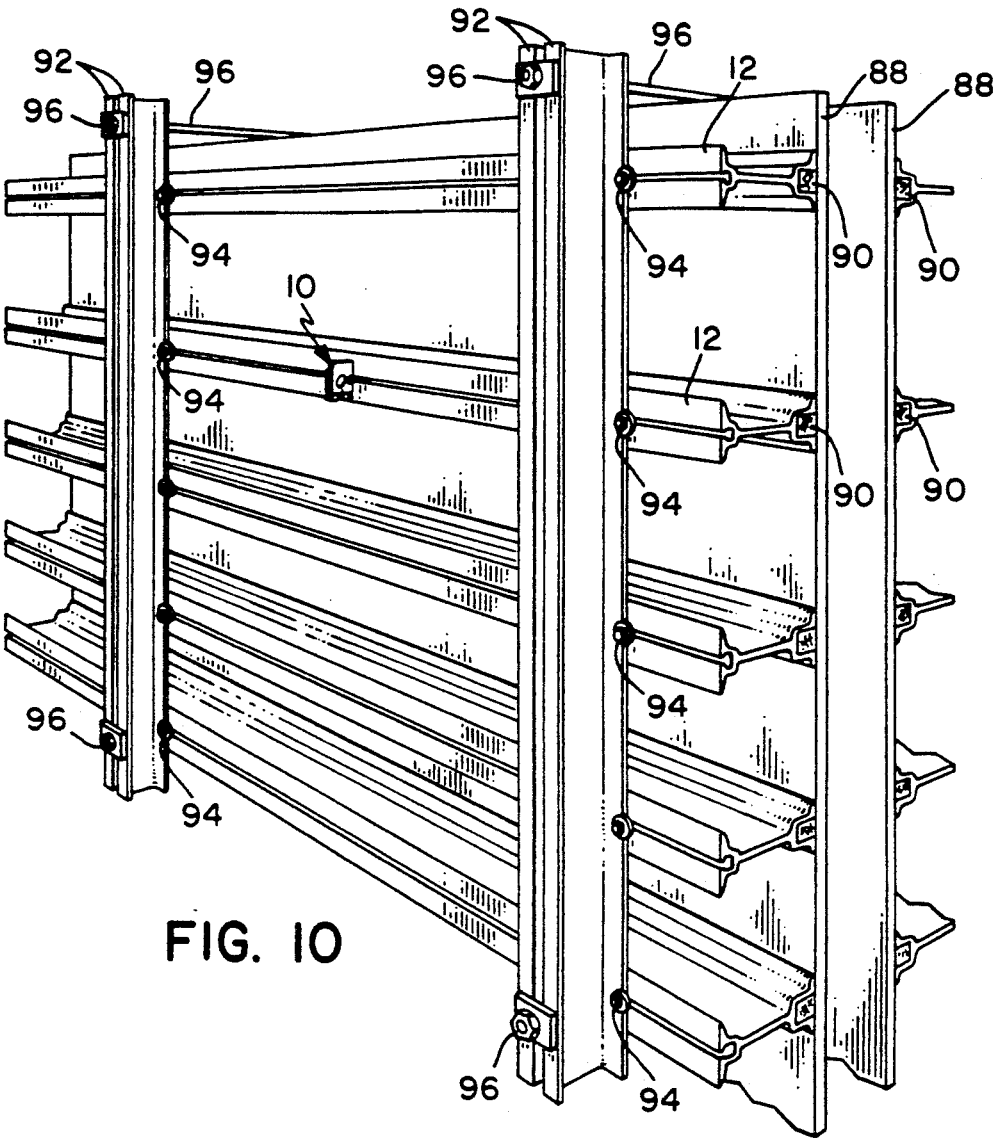
FIG. 10 is a perspective view of the safety anchor of FIG. 1 mounted on a horizontal slotted beam in a flying form constructed using horizontal beams and strongbacks.
Figure 14:
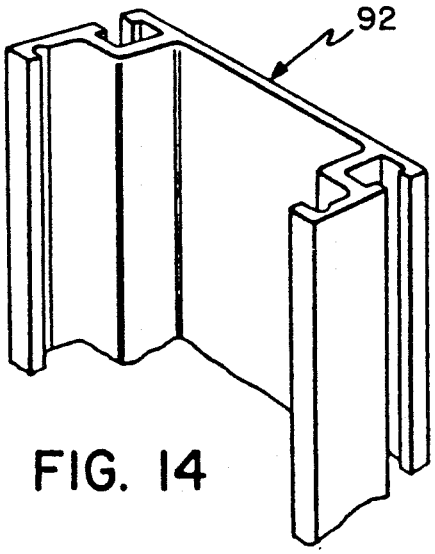
FIG. 14 is a perspective view of a section of the strongback of FIG. 10.

FIGS. 10 and 13 show a conventional flying form arrangement in which horizontal slotted beams 12 approximately twenty one feet in length are disposed in parallel alignment on opposing sides of vertical planking 88 between which concrete will be poured. Studs 90 or two-by-twos are nailed or screwed horizontally to the planking 88, and the "top-hat" sections 36 of the beams 12 are placed over the studs 90 and nailed or screwed thereto. Stiff-backs or strong-backs 92 are placed vertically on opposing sides of the pouring form and are bolted to the beams 12 with conventional threaded bolts 94 that are received within the slots 18 and recessed cavities 30. A section of one of the stiff-backs 92 is shown in FIG. 14. The stiff-backs 92 are then connected with long greased shebolts 96 which tension or compress the pouring form and maintain the proper shape of that form. Workers climb along the beams 12 and build the form upwardly adding planking 88 and beams 12 as the form progresses. The workers may insert the safety anchor 10 of this invention in any slotted beam 12 as they climb, within the limits of the length of their safety lines 84, and continue to work in a given area while safely anchored to the form.

Figure 11:
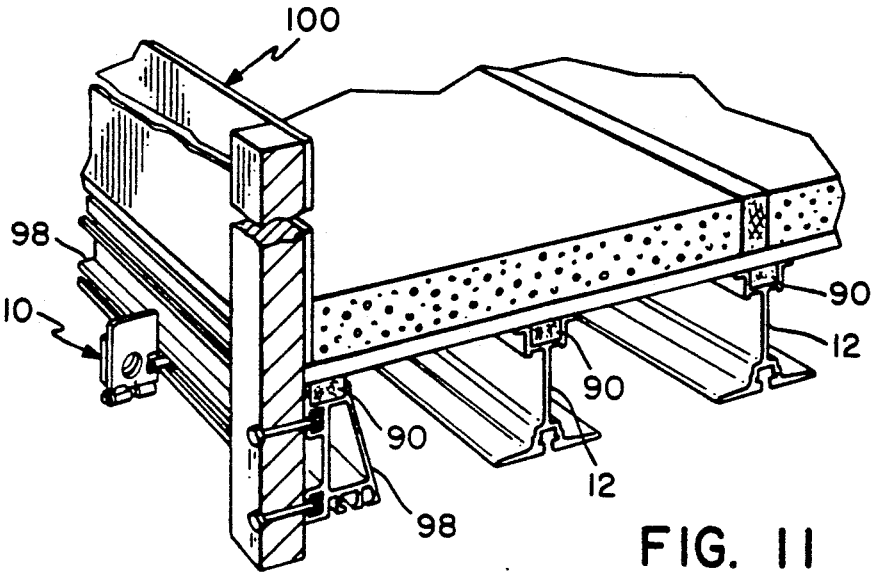
FIG. 11 is a perspective view of the safety anchor of FIG. 1 mounted on an alternate type end beam.

An alternate form of the beam 12 used as a corner or end beam 98 used in other applications, such as when the beams 12, 98 support a slab of concrete being poured within a horizontal form 100, is shown in FIGS. 11 and 14.

Again, reference may be had to U.S. Pat. Nos. 3,899,152; 4,144,690; and 4,156,999 to Avery, as well as U.S. Pat. No. 4,033,544 to Johnston for details and explanations of the slotted beam 12 and other components of the concrete pouring forms, and the discussion herein is merely illustrative.

While the preferred embodiment of the above safety anchor 10 has been described in detail above with reference to the attached drawing figures, it is understood that various changes and adaptations may be made in the safety anchor 10 without departing from the spirit and scope of the appended claims.

What is claimed is:

1. A safety anchor for engagingly and removably mounting on a beam, said beam having a generally planar face with a facial opening and a recessed cavity behind al opening, said facial opening having a height and said recessed cavity having a height greater than said height of said facial opening, said safety anchor comprising:

a first plate, said first plate defining a first aperture extending therethrough;

a second plate, said second plate defining a second aperture extending therethrough, said second plate being operatively connected to said first plate such that said second plate and said first plate may be selectively pivoted between a folded configuration in which said first aperture of said first plate is generally aligned with and closely confronting said second aperture of said second plate and an unfolded configuration; and retention means for engagingly and removably mounting the safety anchor on the beam, said retention means including a pair of retention posts, a first one of said pair of retention posts being connected to and extending from said first plate and a second one of said pair of retention posts being connected to and extending from said second plate, at least a portion of each of said pair of retention posts being removably receivable through the facial opening of the beam when the first plate and the second plate are in the unfolded configuration, and at least a portion of each of said pair of retention posts being engagingly retained within the recessed cavity when the first plate and the second plate are in the folded configuration and the safety anchor is mounted on the beam.

2. The safety anchor of claim 1 wherein each of the first plate and the second plate are pivotally connected to one another by a hinge assembly.

3. The safety anchor of claim 2 wherein the first plate and the second plate each have an inner edge, said inner edge of the first plate confronting said inner edge of the second plate, the hinge assembly comprises:

a first collar, said first collar connected to the inner edge of the first plate and extending generally toward the second plate, said first collar defining a first bore extending at least partially therethrough;

a second collar, said second collar connected to the inner edge of the second plate and extending generally toward the first plate, said second collar defining a second bore extending at least partially therethrough, each of said first bore and said second bore being generally aligned with one another along a common axis; and a hinge pin, said hinge pin being at least partially received within said first bore of said first collar and said second bore of said second collar such that the first plate and the second plate may pivot relative to one another with said hinge pin forming a pivotal axis therebetween.

4. The safety anchor of claim 3 further comprising:

spring biasing means for normally urging the first plate and the second plate into the folded configuration.

5. The safety anchor of claim 4 wherein the spring biasing means includes a coiled torsional spring.

6. The safety anchor of claim 5 wherein the coiled torsional spring is carried on the hinge pin in wrapped relation thereto.

7. The safety anchor of claim 5 wherein the coiled torsional spring is disposed between the first collar and the second collar.

8. The safety anchor of claim 1 wherein each of the pair of retention posts includes a generally cylindrical segment and an enlarged head portion, each said generally cylindrical segment having a diameter less than the height of the facial opening of the beam such that each said generally cylindrical segment may rotate freely when received within the facial opening, each said enlarged head portion having at least two opposing sides separated by a distance, said distance being less than the height of the facial opening such that each said enlarged head portion may be received through the facial opening when the opposing sides thereof are aligned with the facial opening, each said enlarged head portion having a size and a shape such that each said enlarged head portion may rotate within the recessed cavity but may not be received through the facial opening when the opposing sides thereof are not aligned with the facial opening thereby engagingly mounting the safety anchor on the beam.

9. The safety anchor of claim 8 wherein the opposing sides of each of the enlarged head portions of the retention posts are aligned with the facial opening only when the first plate and the second plate are in the unfolded configuration.

10. The safety anchor of claim 9 wherein the first plate and the second plate are generally planar and each have a top surface, and wherein an angle is formed between said top surface of the first plate and said top surface of the second plate when the first plate and the second plate are in the unfolded configuration, said angle being approximately 180°.

11. The safety anchor of claim 9 wherein the first plate and the second plate are generally planar and each have a top surface, and wherein an angle is formed between said top surface of the first plate and said top surface of the second plate when the first plate and the second plate are in the unfolded configuration, said angle being approximately 190°.

12. The safety anchor of claim 8 wherein the opposing sides of each of the enlarged head portions of the pair of retention posts are not aligned with the facial opening when the first plate and the second plate are in the folded configuration and the safety anchor is mounted on the beam.

13. The safety anchor of claim 8 wherein the first plate and the second plate are generally planar and each have a top surface, and wherein said top surface of the first plate is generally parallel with and closely confronting said top surface of the second plate when the first plate and the second plate are in the folded configuration, and wherein the opposing sides of each of the enlarged head portions of the pair of retention posts are not aligned with the facial opening when the first plate and the second plate are in the folded configuration.

14. The safety anchor of claim 8 wherein the opposing sides of the enlarged head portions of both of the pair of retention posts cannot be aligned with the facial opening when the first plate and the second plate are in the folded configuration.

15. The safety anchor of claim 8 wherein the opposing sides of the enlarged head portion of the pair of retention posts are generally planar and parallel with one another.

16. The safety anchor of claim 8 wherein the shape of the enlarged head portion of each of the pair of retention posts is generally cylindrical with the opposing sides being generally planar.

17. The safety anchor of claim 8 wherein the distance between the opposing sides is approximately equal to the diameter of the generally cylindrical segment of the corresponding one of the pair of retention posts.

18. The safety anchor of claim 1 wherein the first plate is generally rectangular and the second plate is generally rectangular.

19. The safety anchor of claim 1 wherein the first plate and the second plate each have a length, said length of the first plate being generally greater than said length of the second plate.

20. The safety anchor of claim 1 wherein the length of the first plate is greater than the length of the second plate by more than one quarter inch.

21. The safety anchor of claim 1 wherein the first plate and the second plate each have a width, said width of the first plate being generally equal to said width of the second plate.

22. The safety anchor of claim 1 wherein the first plate and the second plate each have a thickness, said thickness of the first plate being generally equal to said thickness of the second plate.

23. The safety anchor of claim 1 wherein the first aperture and the second aperture are each generally circular.

24. The safety anchor of claim 1 wherein each of the pair of retention posts has a longitudinal axis, said longitudinal axis intersecting at least a portion of a corresponding one of the first aperture or the second aperture.

25. The safety anchor of claim 1 wherein each of the pair of retention posts has a longitudinal axis and the first aperture and the second aperture each have a center point, said longitudinal axis being aligned with said center point of a corresponding one of the first aperture or the second aperture.

26. A safety anchor for engagingly and removably mounting on a beam, said beam having a generally planar face with a facial opening and a recessed cavity behind said facial opening, said facial opening having a height and said recessed cavity having a height greater than said height of said facial opening, said safety anchor comprising:

a first plate, said first plate defining a first aperture extending entirely therethrough;

a second plate, said second plate defining a second aperture extending entirely therethrough, said second plate being operatively connected to said first plate; and a pair of retention posts, a first one of said pair of retention posts being connected to and extending from said first plate and a second one of said pair of retention posts being connected to and extending from said second plate, at least a portion of each of said pair retention posts being removably receivable through the facial opening of the beam when the first plate and the second plate are in a first orientation, and at least a portion of each of said pair of retention posts being engagingly retained within the recessed cavity when the first plate and the second plate are a second orientation and the safety anchor is mounted on the beam.

27. A safety anchor for engagingly and removably mounting on a beam, said beam having a generally planar face with a facial opening and a recessed cavity behind said facial opening, said facial opening having a height and said recessed cavity having a height greater than said height of said facial opening, said safety anchor comprising:

at least one plate, said plate defining an aperture extending entirely therethrough;

at least one retention post, said retention post being connected to and extending from said plate, at least a portion of said retention post being removably receivable through the facial opening of the beam when said plate is in a first orientation, and at least a portion of said retention post being engagingly retained within the recessed cavity when said plate is in a second orientation and the safety anchor is mounted on the beam; and means for selectively preventing the rotation of said plate between said first orientation and said second orientation.

28. A method for preventing a worker from falling from a structure constructed from a plurality of beams, at least one of said beams having a generally planar face with a facial opening and a recessed cavity behind said facial opening, said facial opening having a height and said recessed cavity having a height greater than said height of said facial opening, said method comprising the steps of:

providing the worker with a safety anchor having at least one plate, said plate having at least one retention post extending therefrom and fixedly attached thereto, at least a portion of said retention post being removably receivable through the facial opening of the beam when said plate is in a first orientation, inserting said retention post through said facial opening with said plate in said first orientation;

rotating said plate to a second orientation in which and at least a portion of said retention post is engagingly retained within the recessed cavity;

providing said safety anchor with means preventing the rotation of said plate from said second orientation to said first orientation; and coupling said safety anchor to the worker with a safety line.

29. A method for preventing a worker from falling from a structure constructed from a plurality of beams, at least one of said beams having a generally planar face with a facial opening and a recessed cavity behind said facial opening, said facial opening having a height and said recessed cavity having a height greater than said height of said facial opening, said method comprising the steps of:

providing the worker with a safety anchor having a pair of plates, said pair of plates being pivotally connected to one another such that said pair of plates may be pivoted between a folded configuration and an unfolded configuration, each of said pair of plates having a retention post extending therefrom and fixedly attached thereto, at least a portion of each said retention post being removably receivable through the facial opening of the beam when said pair of plates is in said unfolded configuration;

pivoting said pair of plates to said unfolded configuration;

inserting each said retention post through said facial opening;

pivoting said pair of plates to said folded configuration such that each said retention post is rotated within said facial opening, at least a portion of each said retention post being engagingly retained within the recessed cavity when said pair of plates is in said folded configuration;

providing said safety anchor with means preventing the pivoting of said pair of plates from said folded configuration to said unfolded configuration; and coupling said safety anchor to the worker with a safety line.

30. The method of claim 29 wherein each of the pair of plates defines an aperture, the step of providing the safety anchor with means preventing the pivoting of the pair of plates from the folded to the unfolded configuration further comprising inserting a safety link through the aperture in each of the pair of plates.

* * * * *

UNITED STATES PATENT AND TRADEMARK OFFICE

CERTIFICATE OF CORRECTION

PATENT NO. : 5,156,233

DATED : 10/20/92

INVENTOR(S) : Gene E. Olson et al.

It is certified that error appears in the above-identified patent and that said Letters Patent is hereby corrected as shown below:

Column 5, line 31, delete --625-- and insert ".625" therefor.

Column 7, line 30, after "shown", insert "with the safety anchor 10 in Figure 1. Other suitable";

Column 9, line 22, delete --al-- and insert "said facial" therefor.

Signed and Sealed this

Fifth Day of October, 1993

Bruce Lehman

*Attest:*

BRUCE LEHMAN

*Attesting Officer*

*Commissioner of Patents and Trademarks*